United States Patent [19]

Ford

[11] 4,365,910

[45] Dec. 28, 1982

[54] STRUT SUPPORT APPARATUS

[75] Inventor: R. Gary Ford, Memphis, Tenn.

[73] Assignee: Steelcraft Corporation, Memphis, Tenn.

[21] Appl. No.: 178,393

[22] Filed: May 15, 1980

[51] Int. Cl.[3] ..... F16D 1/00; F16D 3/00

[52] U.S. Cl. ..... 403/172; 52/81; 403/219

[58] Field of Search ..... 403/172, 217, 218, 219; 52/81

[56] References Cited

U.S. PATENT DOCUMENTS

| | | | |
|---|---|---|---|
| 2,613,966 | 10/1952 | Hocher | 403/217 |
| 3,137,371 | 6/1964 | Nye | 52/81 |
| 3,486,278 | 12/1969 | Woods | 403/172 X |
| 3,635,509 | 1/1972 | Birkemeier et al. | 52/81 X |
| 3,810,342 | 5/1974 | Scott | 52/81 X |
| 4,262,461 | 4/1981 | Johnson et al. | 52/81 |

FOREIGN PATENT DOCUMENTS

| | | | |
|---|---|---|---|
| 841351 | 6/1952 | Fed. Rep. of Germany | 403/218 |

*Primary Examiner*—Wayne L. Shedd
*Attorney, Agent, or Firm*—Martin Novack

[57] ABSTRACT

The disclosure is directed to an apparatus for joining a plurality of struts at a vertex, such as the vertex of a geodesic or a space frame structure. A plurality of strut supports are provided, each strut support including a pair of substantially parallel spaced side plates for receiving and securing one of the struts, with a longitudinal face of the strut aligned with a pair of the longitudinal edges of the side plates. Each strut support also includes a clamp between the side plates, the clamp having a generally rectangular base plate mounted across the side plates in substantially perpendicular relationship to said longitudinal edges of the side plates, such that an end face of the strut can abut against the base plate of the clamp. The clamp also has a pair of generally parallel flanges extending away from the strut at an oblique angle with respect to the flange base plate. The clamps of each of a plurality of strut supports are joined at a tubular hub member that is typically cylindrical or polygonal. This is done by engaging the hub within the flanges of the clamps. Each of the clamps includes a bolt for securing of the clamp to the hub. Due to the oblique angular relationship of the clamp flanges with respect to the clamp base, the same oblique angle is attained between the strut and the plane of the hub (i.e., the plane perpendicular to the axis of the hub). In this manner, it is not necessary to cut the end of each strut at a precise oblique angle for a particular construction, as this angle is provided in the strut joining apparatus, having been predetermined when the apparatus was constructed. When the struts are cut to a particular predetermined length and joined to their hubs in a specific fashion, an entire structure can be built.

18 Claims, 4 Drawing Figures

STRUT SUPPORT APPARATUS

BACKGROUND OF THE INVENTION

This invention relates to apparatus for joining a plurality of beams or struts at a vertex and, more particularly, to such apparatus as used in forming a ribbed frame type of structure upon which a membrane or skin can be supported.

In recent years there has come into widespread use of a type of space frame structure that is free of internal and external support other than the mounting base of the structure, such that the interior of the structure is useful space. There are various forms of such structures, and they are generally known as "geodesic" or "space frame" structures. They find diverse use ranging from small domed storage areas or temporary shelters to huge domed stadiums or auditoriums, as well as flat roof structures.

The individual beam of the described types of structures, typically, although not necessarily, formed of wood or metal, are grouped together in selected geometries, such as triangles, with the vertices of the triangles being joined together at interconnecting hubs. Various types of beam or strut connector systems have been devised for use in geodesic structures. See, for example, U.S. Pat. Nos. 3,186,522; 3,323,820; 3,486,278; 3,635,509 and 3,810,342.

Prior art strut connector systems are found to suffer a number of disadvantages. In some strut connector systems the individual strut connectors and/or strut supports are fairly complicated and, therefore, tend to be expensive and/or difficult to make or field construct. Some systems employ strut supports that require the end of each wooden or metal strut to be cut at a precise oblique angle that is a function of the angle at which the strut is supposed to meet the plane of the hub to which it will ultimately be connected. Also, in most cases a membrane or "skin" of a covering material (for example, plywood or cloth) is generally placed over a ribbed geodesic frame. This being the case, it is desirable that the strut joining apparatus or the hardware used to fasten each strut to its hub or the apparatus to the strut not protrude into the region where the skin of the structure is to be mounted.

It is among the objects of the present invention to provide a strut support system that is sturdy, inexpensive, simple to make and use, and whose use results in a structural frame to which a skin can be readily applied without the interference of protruding hardware.

SUMMARY OF THE INVENTION

The present invention is directed to an apparatus for joining a plurality of struts at a vertex. In accordance with the invention, a plurality of strut supports are provided. Each strut support includes a pair of substantially parallel spaced side plates for receiving and securing one end of one of the struts, with a longitudinal face of the strut aligned with a pair of the longitudinal edges of the side plates. Each strut support also includes a clamp between the side plates, the clamp having a generally rectangular base plate mounted across the side plates in substantially perpendicular relationship to said longitudinal edges of the side plates, such that an end face of the strut can abut against the base plate of the clamp. The clamp also has a pair of generally parallel flanges extending away from the strut at an oblique angle with respect to the flange base plate.

The clamps of each of a plurality of strut supports are joined at a tubular hub member that is typically cylindrical or polygonal. This is done by engaging the hub within the flanges of the clamps. Each of the clamps includes a means for securing itself to the hub, said means typically comprising a bolt which passes through holes in the flanges, located on the interior side of the hub. Due to the oblique angular relationship of the clamp flanges with respect to the clamp base, the complementary oblique angle is attained between the strut and the plane of the hub (i.e., the plane perpendicular to the axis of the hub). This is sometimes called the "axial angle". In this manner, it is not necessary to cut the end of each strut at a precise oblique angle for a particular construction, and all struts can be provided with a conventional 90-degree end face, which greatly facilitates strut construction. The angles at which the struts join the hubs can be mathematically predetermined for geodesic and space frame structures, and these angles can be readily incorporated in the strut connectors of this invention, such that when the connectors are attached to the struts of particular length, the strut will join each hub at the angle necessary to erect the geodesic or space frame structure. Another advantage of the defined structure is that the strut connector itself, and the hardware used to secure each clamp to the hub, does not protrude into the surface generally defined by the outside longitudinal faces of the struts. This facilitates the construction of a skin over an assembled ribbed structure.

In accordance with a further feature of the invention, the hub can include a generally circular disk mounted therein for maintaining the shape of the hub under stress. This is especially valuable when the hub must withstand considerable tension forces. The disk has a plurality of apertures therein to allow passage of the bolts used for securing the strut support clamps.

Further features and advantages of the invention will become more readily apparent from the following detailed description when taken in conjunction with the accompanying drawings.

DESCRIPTION OF THE PREFERRED EMBODIMENT

Figure 1:
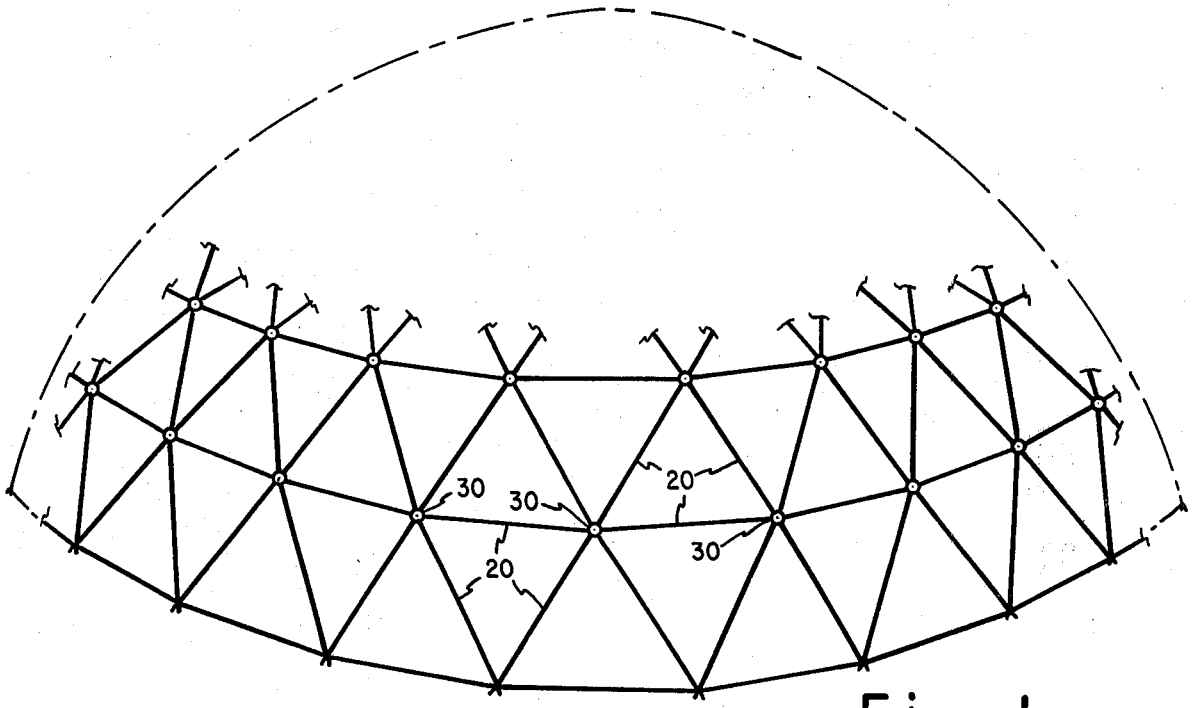
FIG. 1 is a prospective view, partially broken away, of a geodesic type of space frame structure which can be built incorporating the strut supporting and joining apparatus of the present invention.

Referring to FIG. 1, there is shown an example, in partially broken away form, of a geodesic dome structure that includes beams or struts 20 that are joined together at junction points or vertices indicated by reference numeral 30. In the illustrated example, the struts form triangular areas, although it will be understood that other geometrical arrangements can be used.

Figure 2:
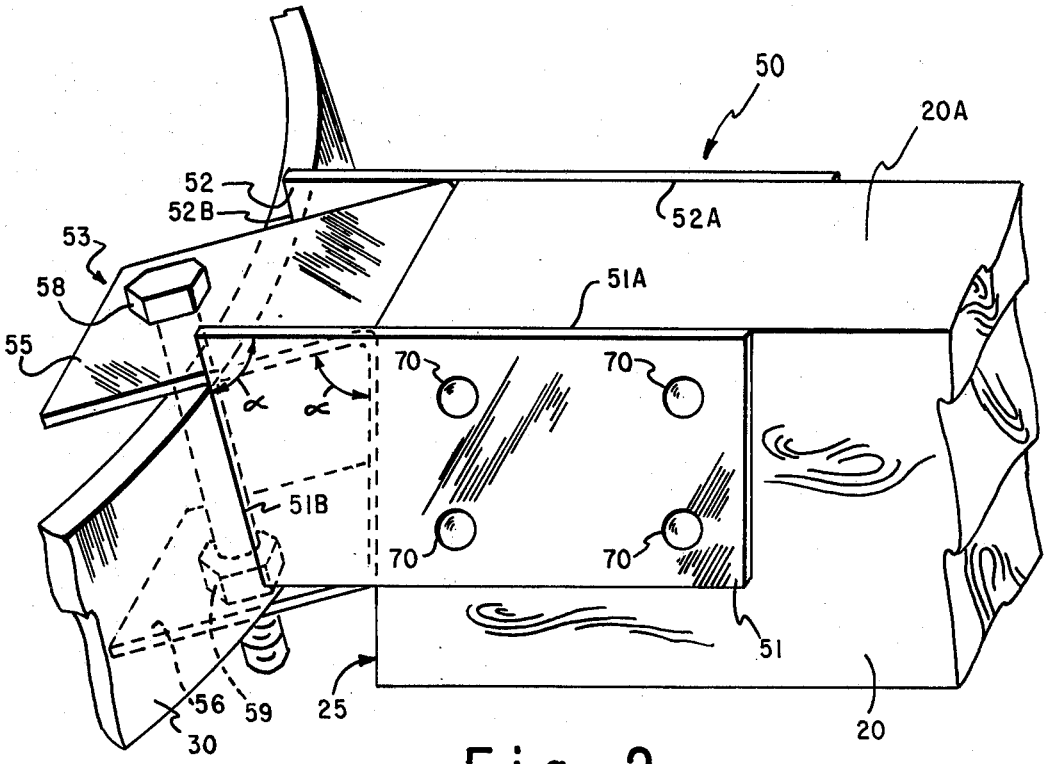
FIG. 2 is an elevational prospective view of the strut support apparatus of the present invention and shows a strut that is joined to a hub via a strut support in accordance with an embodiment of the invention.
Figure 3:
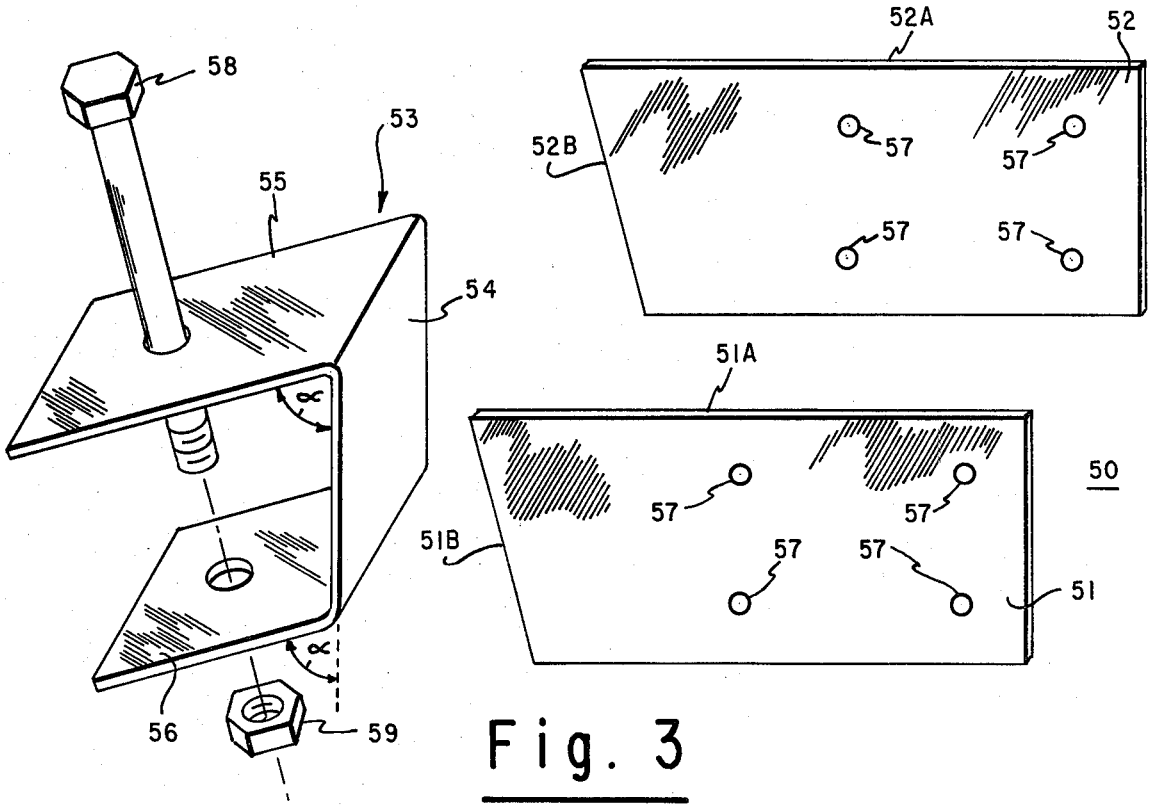
FIG. 3 is an exploded view of the strut support of FIG. 1.

In the present embodiment the struts are wooden and may be, for example, standard 2×4 or 2×6 beams. As seen in FIG. 2, each strut 20 is joined and secured to a hub 30 via a strut support 50.

Each strut support includes a pair of substantially parallel spaced metal side plates 51 and 52 which receive therebetween the strut 20. The side plates 51 and 52 have top longitudinal edges 51A and 52A that are aligned with longitudinal face 20A of the strut 20. A metal clamp 53 has a generally rectangular base plate 54 mounted, preferably by welding, between and across the side plates and substantially perpendicular to the side plates. The clamp 53, which is preferably formed of a single piece of metal, includes upper and lower flanges 55 and 56, respectively, which extend away from the strut 20 and form an oblique angle $\alpha$ with respect to the base plate 54 of the clamp. The right angular end face 25 of the strut 20 abuts against the base plate 54, and nails or screws 70 are driven through perforations 57 in the side plates in order to hold the strut rigidly and in proper position in the strut support 50.

The hub 30 is engaged between the flanges 55 and 56 and is secured thereto using bolt 58 and nut 59. The oblique angle $\alpha$ is seen to determine the angle between the strut and the plane of the hub to which the strut is to be attached. The angle $\alpha$ is preferably in the range between about 85 degrees and 60 degrees. The angles at which the struts join the hubs can be mathematically predetermined for geodesic and space frame structures, and these angles can be readily incorporated in the strut connectors of this invention, such that when the connectors are attached to the struts of particular length, the strut will join each hub at the angle necessary to erect the geodesic or space frame structure. Also, the side plates 51 and 52 are shaped such that the front edges thereof, 51B and 52B, are at the oblique edge $\alpha$ with respect to the top edges 51A and 52A of the side plates. In this manner the edges 51B and 52B will abut against the hub 30 and provide rigidity to the support.

Figure 4:
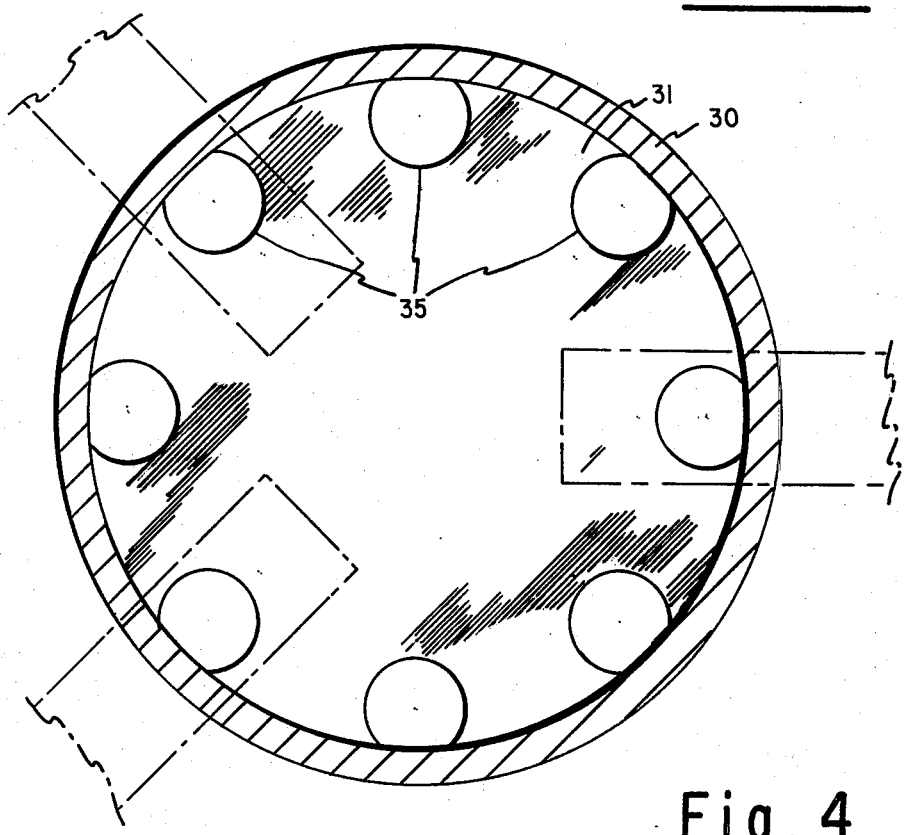
FIG. 4 illustrates a reinforced hub to which a number of strut supports are joined, in accordance with a feature of the invention.

As illustrated in FIG. 4, the hub 30 can include a generally circular thick metal disk 31 mounted therein for maintaining the shape of the hub under strong tension stress. The disk has a plurality of apertures 35 therein to allow passage of the bolts used for securing the strut support clamps. The disk can be affixed inside the hub by welding, for example.

I claim:

1. Apparatus for joining a plurality of struts at a vertex, comprising:

a plurality of strut supports, each including: a pair of substantially parallel spaced side plates for receiving and securing one of said struts with a longitudinal face of said strut aligned with a pair of longitudinal edges of said side plates, and a clamp having a generally rectangular base plate mounted and secured across said side plates and substantially perpendicular to said longitudinal edges of said side plates such that an end face of said strut can abut against said base plate, said clamp having a pair of generally parallel flanges extending away from said strut at an oblique angle with respect to said base plate; and a tubular hub to which a plurality of said clamps are joinable by engaging said hub within the flanges of said clamps;

whereby each strut is joinable to said hub at an angular relationship with respect to the plane of said hub that is defined by said oblique angle.

2. Apparatus as defined by claim 1 wherein said clamp includes holes in said flanges and a bolt fastenable across said holes to secure said clamp to said hub.

3. Apparatus as defined by claim 1 wherein said oblique angle between said flanges and said base plate is in the range between about 85 degrees and 60 degrees.

4. Apparatus as defined by claim 2 wherein said oblique angle between said flanges and said base plate is in the range between 85 degrees and 60 degrees.

5. Apparatus as defined by claim 1 wherein each of said side plates has a front edge that forms an angle with respect to its longitudinal edge that is the same as said oblique angle.

6. Apparatus as defined by claim 3 wherein each of said side plates has a front edge that forms an angle with respect to its longitudinal edge that is the same as said oblique angle.

7. Apparatus as defined by claim 2 further comprising a generally circular disk mounted in said hub member for maintaining the shape of said hub member under stress, said disk having a plurality of apertures therein to allow passage of said bolts therethrough.

8. Apparatus as defined by claim 4 further comprising a generally circular disk mounted in said hub member for maintaining the shape of said hub member under stress, said disk having a plurality of apertures therein to allow passage of said bolts therethrough.

9. Apparatus as defined by claim 1 wherein said struts are wooden struts and wherein said side plates have perforations for receiving nails or screws.

10. Apparatus as defined by claim 3 wherein said struts are wooden struts and wherein said side plates have perforations for receiving nails or screws.

11. For use in an apparatus wherein a plurality of struts are joined at a vertex by coupling the struts to a common tubular hub, an improved strut support for joining a strut to said hub, comprising:

a pair of substantially parallel spaced side plates for receiving and securing a strut, said side plates having a pair of longitudinal edges which are aligned with a longitudinal face of said strut; and a clamp having a generally rectangular base plate mounted and secured across said side plates and substantially perpendicular to said longitudinal edges of said side plates such that an end face of said strut can abut against said base plate;

said clamp having a pair of generally parallel flanges, engagable with said hub, that extend away from said strut at an oblique angle with respect to said base plate;

whereby said strut can be joined to said hub at said oblique angle with respect to the plane of said hub.

12. The strut support as defined by claim 9 wherein said clamp includes holes in said flanges and a bolt fastenable across said holes to secure said clamp to said hub.

13. The strut support as defined by claim 9 wherein said oblique angle between said flanges and said base plate is in the range between about 85 degrees and 60 degrees.

14. The strut support as defined by claim 10 wherein said oblique angle between said flanges and said base plate is in the range between about 85 degrees and 60 degrees.

15. The strut support as defined by claim 11 wherein each of said side plates has a front edge that forms an angle with respect to its longitudinal edge that is the same as said oblique angle.

16. The strut support as defined by claim 13 wherein each of said side plates has a front edge that forms an angle with respect to its longitudinal edge that is the same as said oblique angle.

17. The strut support as defined by claim 9 wherein said struts are wooden struts and wherein said side plates have perforations for receiving nails or screws.

18. The strut support as defined by claim 11 wherein said struts are wooden struts and wherein said side plates have perforations for receiving nails or screws.

* * * * *